United States Patent [19]

Monget et al.

[11] Patent Number: 4,784,886

[45] Date of Patent: Nov. 15, 1988

[54] WRAP-AROUND SLEEVE

[75] Inventors: Pierre Monget, Gondreville; Daniel Caudron, Crepy-en-Valois, both of France

[73] Assignee: The Bentley-Harris Manufacturing Company, Lionville, Pa.

[21] Appl. No.: 48,197

[22] Filed: May 11, 1987

[30] Foreign Application Priority Data

May 12, 1986 [GB] United Kingdom ..... 8611494
Jul. 23, 1986 [GB] United Kingdom ..... 8617972

[51] Int. Cl.[4] ..... B32B 7/00

[52] U.S. Cl. ..... 428/36.1 66/170; 66/202; 428/230; 428/253

[58] Field of Search ..... 66/170, 202; 428/36, 428/253, 230

[56] References Cited

U.S. PATENT DOCUMENTS

| | | | |
|---|---|---|---|
| 4,514,458 | 4/1985 | Thorn et al. | 428/36 |
| 4,532,163 | 7/1985 | Hopper | 428/36 |
| 4,668,563 | 5/1987 | Buese | 428/230 |

*Primary Examiner*—James J. Bell

*Attorney, Agent, or Firm*—John T. Synnestvedt; Charles H. Lindrooth

[57] ABSTRACT

A wrap-around sleeve, for enclosing and protecting an object such as a wire bundle, comprises a plain weft-knitted sheet formed from a filament having an elastic modulus such that the sheet has a sufficiently high transverse curl force (which is the force with which the sheet tends to curl transversely) that the sleeve remains wrapped around the object without separate closure means. Preferably the elastic modulus of the filament is at least 4000 $N.mm^{-2}$.

14 Claims, No Drawings

WRAP-AROUND SLEEVE

The present invention relates to a wrap-around sleeve. The sleeve is suitable for use as a protective sleeve for an elongate article such as a wire bundle.

It is common practice to protect wire bundles, for use in for example the aircraft and automotive industries, from physical damage, for example due to abrasion. The use of a wrap around sleeve can be advantageous since, unlike most tubular sleeves, a wrap around sleeve can be installed around the bundle after connectors (which generally are relatively large in diameter) have been attached to the ends of the individual wires. Hitherto, it has been necessary to provide means for holding such a sleeve in a wrapped configuration, such as the cooperating parts of an elongate interlockable closure, attached to a sleeve along the longitudinal edges thereof; velcro (TM) and zip fasteners are commonly used examples of such closures.

The presence of elongated cooperating closure parts on the longitudinal edges of a wrap around sleeve restricts use of the sleeve to a limited range of wire bundle sizes; furthermore, the flexibility of the sleeve and of a sleeved wire bundle is thereby reduced.

We have now found that a wrap-around sleeve formed by knitting can be fitted around an elongate article such as a wire bundle without the need for separate closure means, so as to protect the article from physical damage.

Accordingly, in a first aspect the invention provides a wrap-around sleeve comprising a plain weft-knitted sheet formed from at least one filament having an elastic modulus such that the sheet has a sufficiently high transverse curl force (as herein defined) that the sleeve remains wrapped around an object without separate closure means.

It is an advantage of the sleeve of the invention that, without the need for closure means to hold it in its wrapped configuration, the sleeve can enclose tightly an elongate article. This arises from the surprisingly high transverse curl force which can be achieved in a sheet knitted from a high elastic modulus filament.

The term "curl force" is used herein to denote the force with which the sheet tends to curl transversely, in use so as to wrap around the substrate. It is measured using tensile test machine by fixing a 50 mm length of sheet with one longitudinally extending edge in each of the jaws. The curl force is the force required to move the jaws apart, so as to open the sheet. The curl force preferably will be arranged to be at least 3 grams force per mm length, more preferably at least 4 grams force per mm length, to ensure a tight fit around an article.

The curl force of the sheet is dependent on several factors, including the material and dimensions of the filament, the number of wales per mm width of the sheet, the number of courses per mm length of the sheet and the length of filament per stitch. The material and dimensions of the filament will be preferably selected to give an elastic modulus of at least 4000 $N.mm^{-2}$, more preferably at least 6000 $N.mm^{-2}$. Suitable materials include polyesters, polyamides, certain polyolefins such as polypropylene, certain aromatic polymers such as polyetheretherkitones, and metal filaments, or wires, for example of an annealed metal such as iron or an alloy thereof. Particularly preferred filaments are polyester filaments diameter 0.35 mm and polypropyelene filaments diameter 0.4 mm.

For certain applications it can be advantageous to incorporate filaments of another material in the sleeve. For example materials may be used which can provide added protection for an article that is wrapped in the sleeve. Filaments of other materials can be twisted with the knitted filaments of the sheet, knitted separately into the sheet, or incorporated in another convenient way. For example, additional physical, electrical or thermal protection may be desirable: physical protection may be provided for example by a dense array of flexible fibres; electrical protection, such as screening, may be provided by a dense array of fine metal wires; and so on.

Preferably the sheet is knitted with a wale width of less than 2.5 mm, especially less than 1.5 mm, ideally less than 1.0 mm, over a substantial part of its width. In one embodiment, the number of wales per mm may be constant across the whole width by the sheet. The term "wale" is used herein to denote a vertical line of substantially identical loops formed by the weft knitting process, and its width is the maximum width of any one of the loops.

Preferably the sheet is knitted with at least 0.1, more preferably at least 0.25 wales per mm width over a substantial part of its width.

Preferably the sheet is knitted with at least 5, more preferably at least 6.5, courses per cm over a substantial part of its length. Generally the number of courses per cm will be constant over the whole length of the sheet although for certain applications, variations in the number may be advantageous. The term "course" is used herein to denote a horizontal row of loops formed by the weft knitting process.

The length of filament per stitch will depend inter alia on the size of the needles, the distance between adjacent needles and the diameter of the filament. Preferably, each stitch in a substantial portion of the sheet comprises from 8 to 12, more preferably from 9.5 to 10.5 mm of the filament.

A high stitch density is preferred since greater curl forces can thereby be achieved. Furthermore, high stitch density gives higher coverage of an article, thereby protecting the article more effectively from physical damage.

The high curl forces which can be achieved in the sleeve of the invention can obviate the necessity for separate closure means. This can provide several advantages of the sleeve in installation and use. For example, any one size of sleeve may be installed on wire bundles having a range of diameters by allowing the extent of overlap of the opposed edges to vary. Such versatility is not possible in a wraparound sleeve with cooperating parts of an elongate closure, such as a zip fastener or a Velcro (TM) fastener, on opposite edges since such sleeves can only be fitted tightly onto one size of bundle; accordingly, by virtue of the present invention, inventory of wraparound sleeves can be reduced. Furthermore, the absence of a relatively longitudinally rigid closure member allows the sleeve to be stretched longitudinally, for example to tighten further the sleeve around an article or to allow an enclosed article to be flexed. A yet further advantage is that the absence of separate closure means allows the sleeve to be made of a single material. This allows the performance characteristics of the sleeve to be controlled accurately.

The sleeve of the invention may be arranged to be wrapped helically around an article.

For some applications, it can however be advantageous to provide closure means to hold yet more securely the wrapped sleeve around an article. Such closure means may be used advantageously for example when the enclosure article is subjected to many collisions with, and/or abrasions against, other objects when in use. Especially preferred closure means include tie-wraps, which may be of the same material as that of the filament of the sheet.

The sheet may be knitted on a circular knitting machine as a tube which subsequently is slit. The slit tube may have a tendency to fray along its edges, but this tendency can be minimised by heat sealing or by seaming.

It is particularly preferred to knit the sheet on a flat knitting machine since the sheet can conveniently be knitted with edges which are not susceptible to fraying; furthermore, the absence of heat sealing and seaming along the edges allows the sheet to be stretched longitudinally.

Formation of the sleeve of the invention by knitting a sheet allows the characteristics of the sleeve to be modified according to requirements, by varying the stitch configuration. This may conveniently be achieved by varying the configuration of the needles on which the sheet is knitted. For example, by changing the configuration of the needles, the operator can change the dimensions of the sheet, the profile of curl forces across the sheet and the profile of the wrapped sheet.

The profile of curl forces across the sheet may be varied by knitting the sheet with one or more wales having width which is a multiple of the width of a substantial number of the other wales. This may conveniently be achieved by knitting the sheet on an array of regularly spaced needles of which at least one is not used to form a stitch. This will, in effect, produce a course in which a stitch has two, three or more times the width of the other stitches, and a plurality of successive ones of such courses will produce a multiple width wale. In a preferred embodiment, the needle which is not used to form a stitch may be between the second and fourth from a longitudinal edge of the sheet; it is particularly preferred that the third needle from one or both of the edges of the sheet be unused. This leads to several significant advantages in installation of the sleeve and in use. In particular, it has been found that the presence of a multiple width wale towards an edge of the sheet affects the profile of curl forces so as to produce an inwardly turned flange extending longitudinally along the sheet edge. This flange facilitates installation of the sleeve as described below. Furthermore, in an installed sleeve, such a flange when overlapped with an underlying layer of the sleeve tends to grip the said layer so as to reduce the tendency of the installed sleeve to unwrap, for example on abrasive contact with another object. Such a flange can therefore act as a closure member. Yet further, it has been found that the presence of an inwardly turned flange along one, or more preferably both of the longitudinal edges of the sheet enables wrapping of the sleeve, for example around an article to be better controlled. Thus the wrapping can more easily be arranged to be around substantially only one of the edges of the sleeve.

The characteristics of the sleeve may also be modified by knitting at least a portion, preferably all, of the sheet with two or more filaments. This enables greater curl forces to be achieved.

The sleeve of the invention may be adapted to be wrapped around a branched article which may be T- or Y-shaped for example. This may be achieved by slitting the knitted sheet longitudinally along a part of its length so as to form two or more longitudinally extending branch portions of the sheet, each of which can be wrapped transversely around a branch of the article. When it is desirable to slit the sheet along a portion of its length, it is preferred to make the slit along a multiple width wale. When the branch portions of the sleeve are to be wrapped around substantially equally sized branches of the article, the multiple width wale will be substantially central on the sleeve.

The sleeve of the invention can be conveniently installed around an article by opening the sleeve (by overcoming the curl forces), positioning the article within the sleeve and then allowing the sleeve to wrap around the article. Preferably, the sleeve is installed around an elongate article using a tool which comprises:

(a) a pair of spaced apart generally parallel rails having a feed end and a take off end, and being arranged to engage the edges of the sleeve so as to hold open the sleeve as it moves relative to the rails in a direction from the feed end towards the take off end; and (b) an article feed conduit, positioned relative to the rails for feeding an article into a sleeve held open by the rails towards the said take off end as the sleeve is moved along the rails;

the rails converging towards the take off end in such a way that one of the edges of the sleeve is allowed to wrap around an article so fed.

In one embodiment, the rails are provided by the rims of a generally U- or V-shaped channel member, the sleeve being moved along the outside thereof. Ths rails may however be held apart by one or more struts extending between the rails.

Use of the tool is particularly convenient when the sheet is knitted so as to produce a sleeve with an inwardly turned flange extending along each longitudinal edge, since the pair of rails can engage positively the flanges of the sleeve to hold the sleeve open.

The article feed conduit serves to direct the article into the channel member for enclosure by the sleeve as the article and the sleeve are taken off at the end of the rails. Thus it may comprise an arrangement of guide pegs or rollers, or a secondary channel member. The article feed conduit may be modified to accomodate branched articles.

We claim:

1. A wrap-around sleeve comprising a plain weft-knitted sheet formed from at least one filament having an elastic modulus such that the sheet has a sufficiently high transverse curl force (as herein defined) that the sleeve remains wrapped around an object without separate closure means.

2. A sleeve as claimed in claim 1, in which the elastic modulus of the filament is at least 4000 $N.mm^{-2}$.

3. A sleeve as claimed in claim 1, in which the width of each wale is less than 2.5 mm over a substantial part of the width of the sheet.

4. A sleeve as claimed in claim 1, in which the sheet has at least 5 courses per cm length over a substantial part of its length.

5. A sleeve as claimed in claim 1, in which each stitch in a substantial portion of the sheet comprises from 8 to 12 mm of the filament.

6. A sleeve as claimed in claim 1, in which over at least a portion of the length of the sheet, the width of at least one wale is a multiple of the width of each of a substantial number of the other wales.

7. A sleeve as claimed in claim 6, in which the multiple width wale is produced by knitting the sheet on an array of regularly spaced needles of which at least one is not used to form a stitch.

8. A sleeve as claimed in claim 7, in which the needle not used to form a stitch is the third needle from an end of the array.

9. A sleeve as claimed in claim 7, in which the needle not used to form a stitch is substantially central in the array.

10. A sleeve as claimed in claim 1, in which the sheet is slit along a portion of its length.

11. A sleeve as claimed in claim 1, in which at least a portion of the sheet is formed from two filaments knitted together.

12. A knitted wrap-around sleeve having a transverse curl force (as herein defined) of at least 3 grams force per mm length and a knitted closure portion formed integrally therewith.

13. An elongate article which is enclosed along at least a part of its length by a wrap-around sleeve as claimed in claim 1.

14. An elongate article as claimed in claim 13, which comprises a wire bundle.

* * * * *